United States Patent [19]

Kozacka

[11] 4,153,892

[45] May 8, 1979

[54] FUSIBLE ELEMENT AND PROCESS OF MANUFACTURING SAID ELEMENT

[75] Inventor: Frederick J. Kozacka, South Hampton, N.H.

[73] Assignee: Gould Inc., Rolling Meadows, Ill.

[21] Appl. No.: 849,171

[22] Filed: Nov. 7, 1977

[51] Int. Cl.[2] ..... H01H 85/04

[52] U.S. Cl. ..... 337/159; 337/229; 337/293

[58] Field of Search ..... 337/158, 159, 161, 229, 337/290, 291, 293

[56] References Cited

U.S. PATENT DOCUMENTS

| | | | |
|---|---|---|---|
| 3,569,891 | 3/1971 | Cameron | 337/161 |
| 3,801,945 | 4/1974 | Howard | 337/159 |

*Primary Examiner*—George Harris
*Attorney, Agent, or Firm*—Erwin Salzer

[57] ABSTRACT

A fuse having a composite fusible element comprising a plurality of separate, parallel, equidistantly spaced wires. A plurality of bridges of electric insulating material is arranged substantially transversely to the aforementioned wire-like fusible elements at spaced fixed points thereof integrating said plurality of fusible elements into a ribbon-like unitary structure and maintaining said wire-like fusible elements equidistantly spaced at said plurality of points thereof. Said plurality of wire-like fusible elements are wound helically around a prismatic surface in such a way that said plurality of bridges are located between the edges of said surface.

7 Claims, 7 Drawing Figures

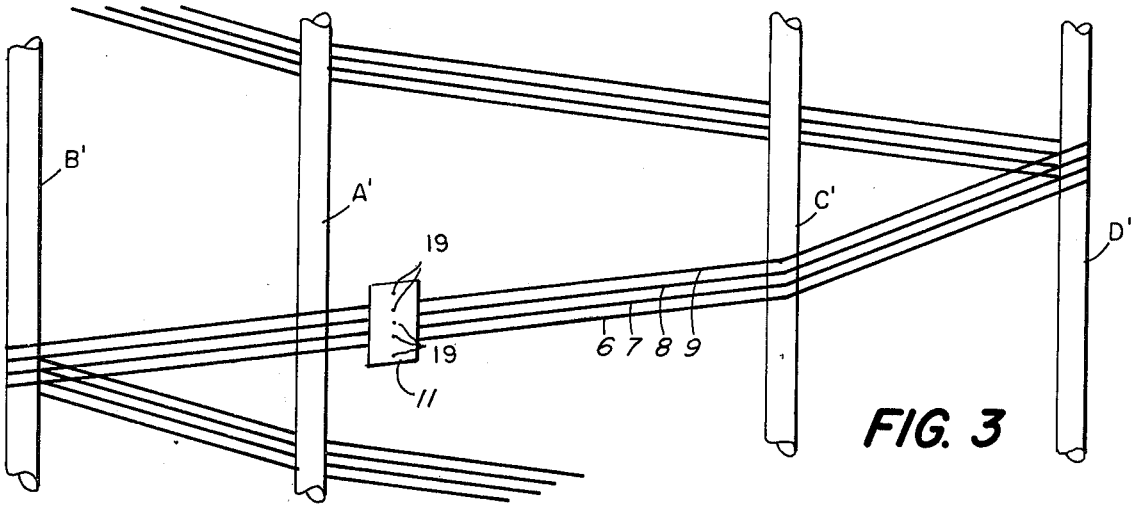
FIG. 3
FIG. 4
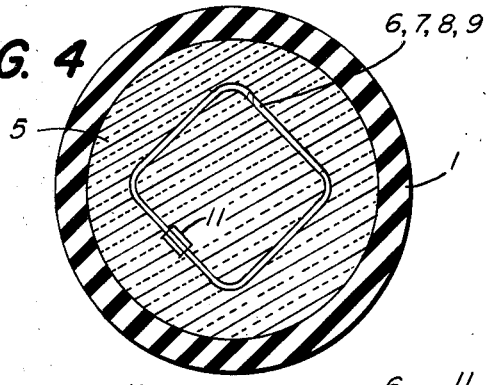
FIG. 5
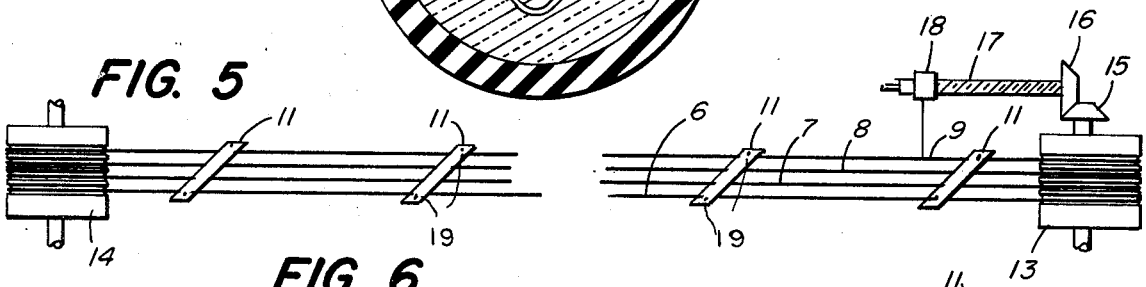
FIG. 6
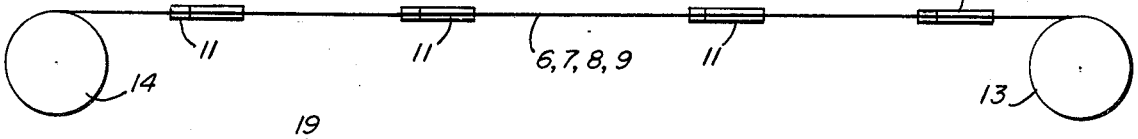
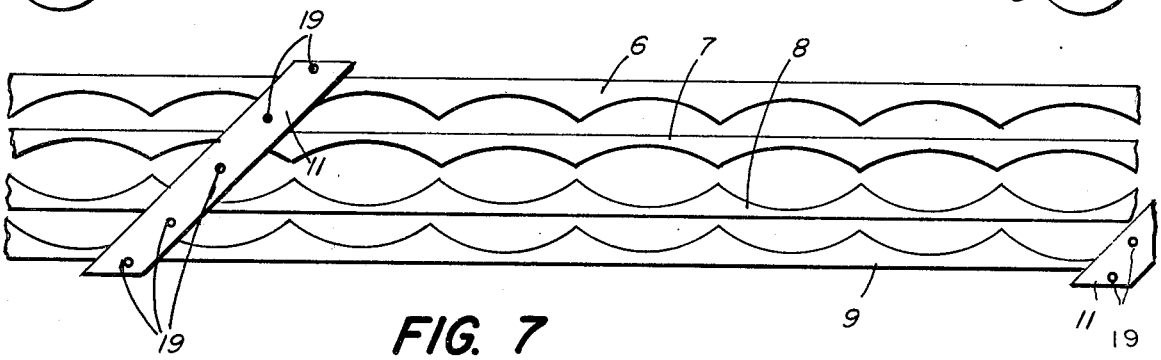
FIG. 7

FUSIBLE ELEMENT AND PROCESS OF MANUFACTURING SAID ELEMENT

BACKGROUND OF THE INVENTION

Fuses for elevated circuit voltages, e.g. 15 Kv., are made in two different forms, namely single element fuses and multielement fuses. In the former there is but one single fusible element, while the latter include a plurality of separate, equidistantly spaced fusible elements connected in parallel. In both types of fuses the fusible elements are wound helically if their length exceed the spacing between the terminal elements of the fuse. The single element fuses are relatively simple to manufacture, but their performance is poor, particularly if their current rating is relatively high. The multielement fuses are relatively difficult to manufacture, particularly if their constituent fusible elements are wire-like rather than in the form of more or less wide metal ribbons. The manufacturing difficulties of multielement fuses increases, if the fuses are not provided with a support whose cross-section is more or less starshaped . The relatively greatest manufacturing difficulties are encountered in supportless fuses for the fusible element such as taught in U.S. Pat. No. 3,848,214 to Erwin Salzer, 12/12/74 for METHOD OF ASSEMBLING ELECTRIC HIGH-VOLTAGE FUSES AND SUB-ASSEMBLY THEREFOR, and in U.S. Pat. No. 3,810,061 to Erwin Salzer, 05/07/74 for HIGH-VOLTAGE FUSE. In spite of the aforementioned difficulties the trend is toward multielement fuses, because of their far superior performance involving sequential break-formation in the fusible elements thereof.

It is the primary object of this invention to provide means which make it possible to manufacture multielement fuses without significant difficulties, particularly fuses whose constituent fusible elements are wire-like and more specifically fuses having no conventional fuse element support substantially star-shaped in cross-section, such as disclosed in the above referred-to U.S. Pat. Nos. 3,848,214 and 3,810,061.

Other objects and advantages of the present invention will become more apparent from what follows.

SUMMARY OF THE INVENTION

Fuses for elevated circuit voltages embodying the present invention include a tubular casing of electric insulating material, a pair of terminal elements closing the ends of said casing, a plurality of fusible elements spaced equidistantly, wound in substantially helical turns and conductively interconnecting said pair of terminal elements, and a pulverulent arc-quenching filler inside said casing surrounding said plurality of fusible elements. The novel feature of fuses according to this invention consists in a plurality of separate bridges of electric insulating material arranged substantially transversely to said plurality of fusible elements at spaced fixed points thereof tying together and thus integrating said plurality of fusible elements into a ribbon-like unitary structure and maintaining said plurality of fusible elements equidistantly spaced at said fixed points thereof. Said ribbon-like unitary structure is wound around a prismatic surface in such a way that said plurality of bridges are located between the edges of said surface.

Manufacturing a multiple fusible element according to this invention comprises the steps of arranging a plurality of fusible elements in parallel equidistant relation in a common plane, bridging said fusible elements by a plurality of spaced insulating bridges joining fixed points of said wires and fixed points of said bridges and thus forming an integral, ribbon-like fusible-element-and-bridge structure, cutting predetermined lengths from said structure, and thereafter winding said predetermined lengths into helical shape to produce integral parallel multiple helical current paths.

BRIEF DESCRIPTION OF THE DRAWINGS

FIG. 3 is an isometric view showing one full turn of a fusible element according to the present invention;

FIG. 4 is a cross-section through a fuse embodying the present invention taken along 4—4 of FIG. 1;

FIG. 5 is a diagrammatic representation in top-plan view of a device for manufacturing fusible elements according to the present invention;

FIG. 6 is a diagrammatic front elevation of the structure shown in FIG. 5; and FIG. 7 shows a fusible element according to the present invention in top-plan view.

DESCRIPTION OF PREFERRED EMBODIMENT

Figure 1:
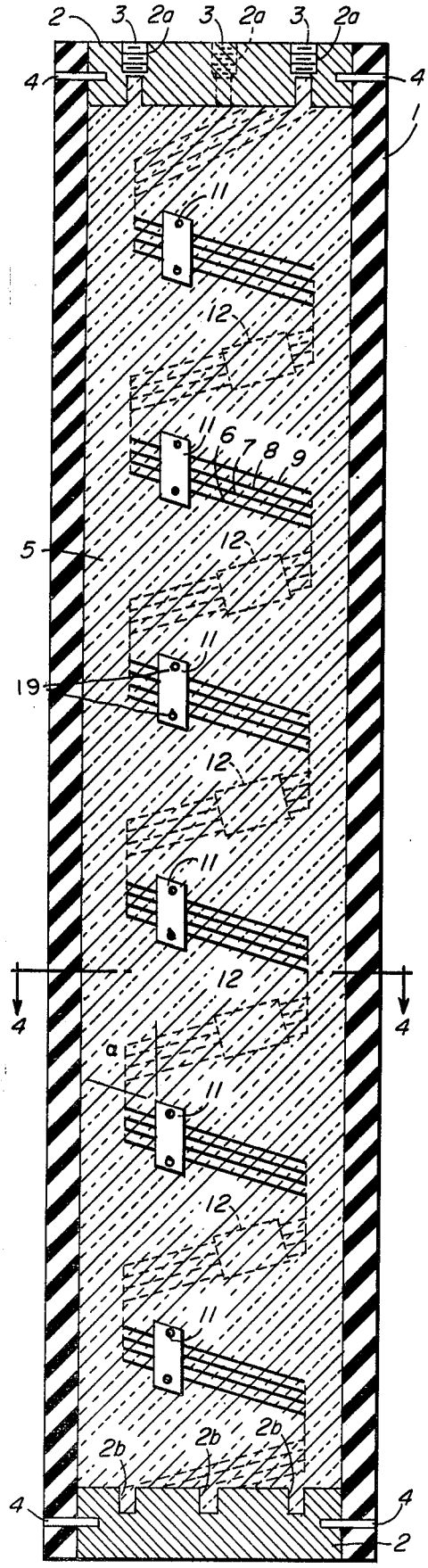
FIG. 1 is a vertical section through a fuse embodying the present invention.
Figure 2:
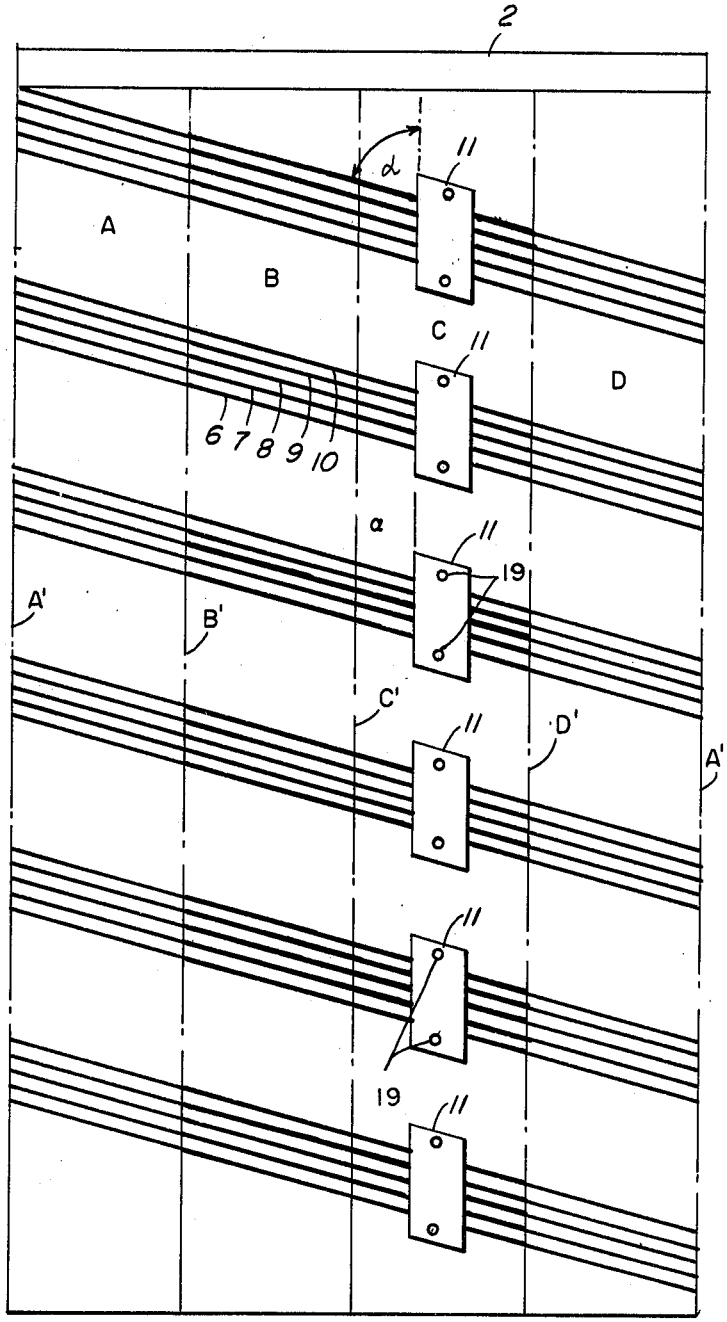
FIG. 2 shows a structure embodying the invention cut open along a longitudinal edge of a prism upon which it is wound and spread out in the plane of the drawing paper.

Referring to FIGS. 1, 2, 3 and 4, numeral 1 has been applied to designate a tubular casing of electric insulating material closed on both ends thereof by a pair of terminal elements in the form of plugs 2. The upper plug 2 is provided with four screw-threaded holes **2*a* arranged in the shape of a square, and the lower plug 2 is provided with four circular holes 2*b* arranged in registry with holes 2*a*. Holes 2*a*, 2*b* are intended for insertion of winding support rods, as explained in detail in the above U.S. Pat. Nos. 3,848,214 and 3,810,061. Since FIGS. 1 and 2 show a completed fuse, these support rods have been removed and do not appear in FIGS. 1, 2 and 4. FIG. 1 shows plugs 3 closing holes or bores 2*a*. FIG. 1 further shows steel pins 4 projecting transversely through casing 1 into terminal plugs 2 for affixing the latter to the former. A pulverulent arc-quenching filler 5, e.g. quartz sand, is filled into casing 1. An opening for filling filler 5 into casing 1 is provided in upper plug 2, but does not appear in FIG. 1**.

According to FIG. 1 terminals 2 are conductively interconnected by four wire-like fusible elements 6,7,8,9. FIG. 2 shows five separate, parallel equidistantly spaced wire-like fusible elements 6,7,8,9,10, while FIG. 3 shows four such elements 6,7,8,9. Bridges 11 of electric insulating material are arranged substantially transversely to said plurality of wire-like fusible elements 6,7,8,9 and 6,7,8,9,10, respectively. These bridges 11 are arranged at spaced fixed points of said fusible elements, and integrate the same into a ribbon-like unitary structure, maintaining the fusible elements equidistantly spaced at said points thereof. Fusible elements 6,7,8,9 and 6,7,8,9,10, respectively, are wound helically around a prismatic surface A,B,C,D. For the sake of greater clarity the quarter turns of the helical windings lying in front of the above referred-to surface have been indicated by relatively thick lines in FIGS. 1, 2, while the quarter turns lying in back of said surface have been indicated in dotted lines. The edges of said surface have been indicated in FIG. 2 by the reference characters A',B',C',D',A'. It will be apparent from the drawing that bridges 11 are arranged relative to the wire-like fusible elements at acute angles $\alpha$. The angles $\alpha$ are selected in such a way that the insulating bridges 11 extend parallel to the longitudinal axis around which helixes 6,7,8,9 and 6,7,8,9,10 are wound. This angle is, in turn, determined by (a) the angular relation between said plurality of wire-like fusible elements and said insulating bridges, and (b) the pitch of the helix formed by fusible elements 6,7,8,9 and 6,7,8,9,10, respectively.

Each of bridges 11 is formed by a pair of straight plates of electric insulating material sandwiching therebetween said plurality of fusible elements as can best be seen in FIG. 4. The plates of which bridges 11 are made may be either of a material which does not evolve gases under the action of an electric arc, or of a material which evolves gases under the action of an electric arc. Bridges 11 are not the best means of producing arc-extinguishing gas blasts. Other means ought to be supplied to produce arc extinguishing gas blasts if needed. These other means are preferably beads 12 shown in FIG. 1. Beads 12 are made of melamine resin and inorganic fillers and shaped to surround each of said wire-like fusible elements 6,7,8,9 and 6,7,8,9,10. For a more detailed description of such beads reference may be had to my U.S. Pat. No. 3,810,062, 05/07/74 for HIGH-VOLTAGE FUSE HAVING FULL RANGE CLEARING ABILITY (See particularly FIG. 3 of U.S. Pat. No. 3,810,062, and its context).

The manufacture of fuses according to the above referred-to U.S. Pat. Nos. 3,848,214 and 3,810,061 involved little difficulties as long as fuses of standard size are concerned. Removal of the four supporting rods and filling of the fuses with sand may cause some small distortions of the fusible element, but such distortions are so small that they lie within permissible tolerance limits. When fuses according to U.S. Pat. Nos. 3,848,214 and 3,819,061 are manufactured in sub-standard sizes, the occurring tolerances may exceed the tolerance limit. It is in such instances where the present invention is particularly valuable. Referring to FIG. 3, this figure shows four parallel rods A',D',C',B'. A turn of winding 6,7,8,9 comprises the four quarter turns A',D',D',C';C',B',A'. Any of the four rods A',D',C',B' may be withdrawn so that winding 6,7,8,9 may ultimately be supported by none of the four rods A',D',C',B', or by three rods A',D',C' and/or by two rods A',C' only, or by one single rod A'. Rods intended to remain in the casing upon filling thereof with an arc-extinguishing filler 5 must be of insulating material while rods A',D',C',B' which are withdrawn from the casing before completion of the fuse must be of metal. A fuse having but one or two single rods and thus supporting each full turn of a fusible element at only one or two points is disclosed in my U.S. Pat. No. 3,843,948, 10/22/74 for HIGH-VOLTAGE FUSE to which reference may be had for further details regarding such fuses.

Referring now to FIGS. 5 and 6, numerals 6,7,8,9 have been applied to indicate four wire-like fusible elements extending from supply roll 13 to take-up roll 14. The supply roll 13 drives a pair of bevel gear 15,16 and the latter drives the spindel or worm gear 17. Mounted on spindel 17 is an indicator 18 which travels from right to left when supply roll 13 is driven by an electromotor (not shown). When indicator 18 reaches its extreme left position, bridge 11 is affixed to fusible elements 6,7,8,9 and indicator 18 is uncoupled from spindel 17 and returned to its initial right position. After a given number of bridges 11 has been affixed to fusible elements 6,7,8,9, the latter are cut or severed from supply spool 13 and stored on take-up roll 14 or in any other desired way. The length of each section of fusible elements thus made depends on the rated voltage of the fuse for which it is intended, the number of bridges per unit of length, etc. FIG. 6 shows the finished product of composite wire-like fusible ribbon. The latter comprises four scalloped wire-like fusible elements. The width of these elements has been slightly exaggerated in FIG. 6 in the interest of increased clarity. Actual dimensions are shown in my U.S. Pat. No. 3,743,994, 07/03/73 for RIBBON TYPE FUSIBLE ELEMENT FOR HIGH-VOLTAGE FUSES AND FUSE INCLUDING THE ELEMENT.

Any kind of suitable fastener means may be used for affixing the bridge-forming plates 11 to fusible elements 6,7,8,9 and 6,7,8,9,10, respectively. The preferred means are eyelets 19 arranged between the wire-like fusible elements 6,7,8,9, as shown in FIG. 7.

It will be apparent from the drawings that each of bridges 11 has the shape of a parallelogram with the shorter sides thereof parallel to windings 6,7,8,9, and windings 6,7,8,9,10, respectively, the longer sides thereof enclosing an acute angle with the above referred-to windings and extending parallel to the axis of the prism around which the fusible elements are wound. It will be further apparent from the drawings that bridges 11 tie together all of the fusible elements of a fuse such as the four fusible elements of FIG. 4, or the five fusible elements of FIG. 2.

I claim as my invention:

1. A fuse for elevated circuit voltages including a tubular casing, a pair of terminal elements closing the ends of said casing, a plurality of spaced parallel fusible element wound in substantially helical turns and conductively in connecting said pair of terminal elements, and a pulverulent arc-quenching filler inside said casing surrounding said plurality of fusible elements wherein the novel features comprise (a) a plurality of separate bridges of electric insulating material arranged substantially transversely to said plurality of fusible elements at spaced fixed points thereof tying together and thus integrating said plurality of fusible elements into a ribbon-like unitary structure, and maintaining said plurality of fusible elements equidistantly spaced at said fixed points thereof; and (b) said ribbonlike unitary structure being wound around a prismatic surface in such a way that said plurality of bridges are located between the edges of said surface.

2. A fuse as specified in claim 1 wherein each of said plurality of bridges has the shape of a parallelogram, wherein said plurality of bridges are arranged relative to said plurality of fusible elements at an acute angle and parallel to the axis of the prismatic surface on which said plurality of elements are located, and wherein the narrow sides of said plurality of bridges are parallel to the direction of the windings of said plurality of fusible elements.

3. A fuse as specified in claim 1 wherein each of said bridges is formed by a pair of straight plates of electric insulating material, sandwiching therebetween all of said plurality of fusible elements and enclosing such angles with all of said plurality of fusible elements that the longitudinal edges of said plates extend parallel to the longitudinal axis of said casing.

4. A fuse as specified in claim 3 wherein each of said pair of plates is joined together by a plurality of eyelets arranged between said fusible elements.

5. A fuse as specified in claim 1 wherein said ribbonlike unitary structure fusible elements are arranged in four-sided prismatic surface, and wherein the number of points of support of said plurality of fusible elements per turn thereof is less than four.

6. A process of manufacturing an electric fuse for elevated circuit voltages comprising the steps of (a) arranging a plurality of fusible elements in parallel equidistant relation in a common plane;

(b) bridging all of said plurality of fusible elements by a plurality of separate, transverse insulating bridges spaced from each other in a direction longitudinally of said plurality of fusible elements and joining fixed points of all of said plurality of fusible elements and fixed points of said plurality of bridges and forming an integral ribbonlike fusible element-and-bridge structure;

(c) cutting predetermined lengths from said integral fusible-element-and-bridge structure; and thereafter (d) winding said predetermined lengths into the shape of a helix and thus establishing multiple parallel integral helical current paths.

7. A process as specified in claim 6 comprising the step of selecting the angular relation between said plurality of fusible elements and further selecting the pitch of said helix in such a way that said insulating bridges extend parallel to the longitudinal axis of said helix.

* * * * *